US006499332B2

(12) United States Patent
Clingan, Jr.

(10) Patent No.: US 6,499,332 B2
(45) Date of Patent: Dec. 31, 2002

(54) WHEEL ALIGNMENT APPARATUS FOR BENDING FRONT AXLES

(75) Inventor: Robert W. Clingan, Jr., Liberal, KS (US)

(73) Assignee: Progressive Marketing, Inc., Liberal, KS (US)

( * ) Notice: Subject to any disclaimer, the term of this patent is extended or adjusted under 35 U.S.C. 154(b) by 0 days.

(21) Appl. No.: 09/796,272

(22) Filed: Feb. 28, 2001

(65) Prior Publication Data

US 2002/0116979 A1 Aug. 29, 2002

(51) Int. Cl.[7] ..... B21D 1/14
(52) U.S. Cl. ..... 72/455; 72/705; 100/269.17
(58) Field of Search ..... 72/389.6, 455, 72/705, 389.7; 100/269.17; 403/188, 365

(56) References Cited

U.S. PATENT DOCUMENTS 1,739,891 A 12/1929 Dimmick
1,777,686 A 10/1930 Bagge
1,890,935 A 12/1932 Creagmile et al.
2,417,697 A * 3/1947 Loomis ..... 72/455
2,481,766 A 9/1949 Merrill et al.
2,830,789 A 4/1958 MacMillan
3,765,219 A 10/1973 Easom, Jr.
3,777,542 A 12/1973 Foshee et al.
4,067,222 A 1/1978 Eck

* cited by examiner

*Primary Examiner*—Lowell A. Larson
(74) *Attorney, Agent, or Firm*—Kenneth W. Iles

(57) ABSTRACT

A pair of upright arms are connected at their lower ends to an anchoring beam that lies on the floor after the truck is driven onto a ramp. The front truck axle is positioned below the top ends of the upright arms, which are then joined by a pressure distributor located above the axle to form an upright arm assembly. A hydraulic ram presses upwardly against the axle, which is restrained by the pressure distributors, thereby bending the axle to align the wheels. A system of countersunk apertures and mating conical frustrum fittings and bushings distribute the resulting forces more evenly throughout the apparatus, thereby preventing bending of the upright arms.

11 Claims, 5 Drawing Sheets

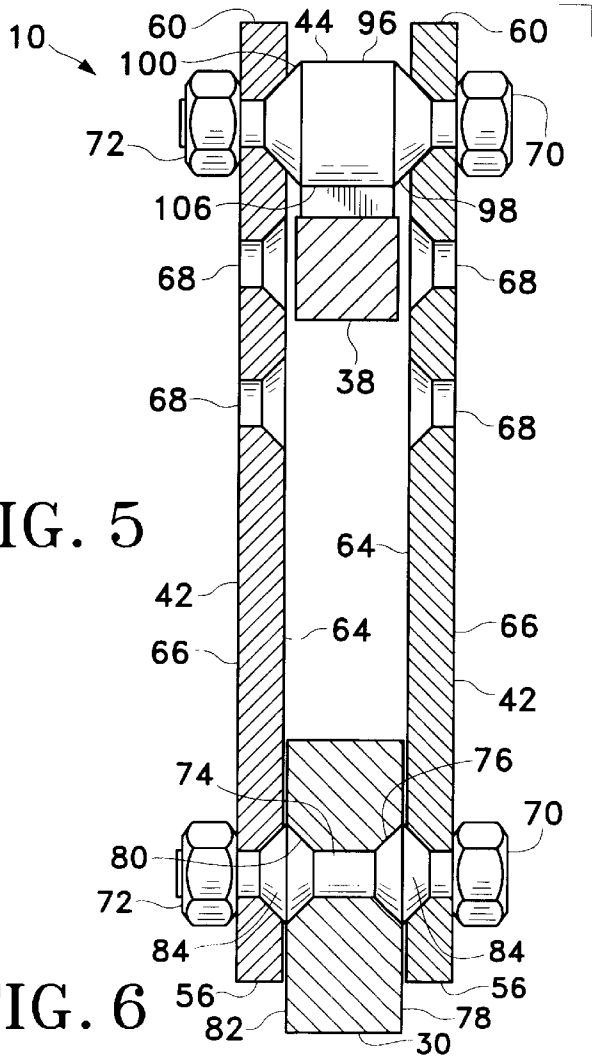
FIG. 5
FIG. 6
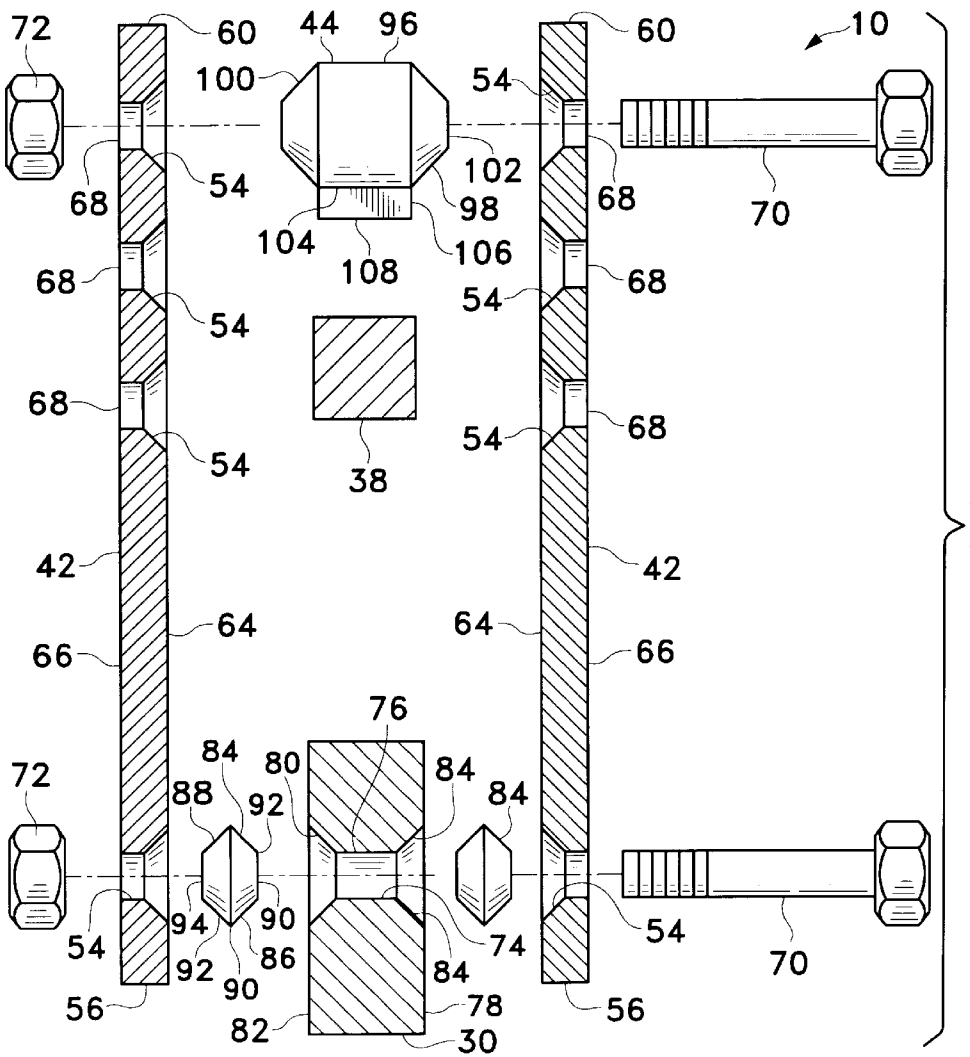

WHEEL ALIGNMENT APPARATUS FOR BENDING FRONT AXLES

CROSS-REFERENCE TO RELATED APPLICATIONS

Not Applicable.

STATEMENT REGARDING FEDERALLY SPONSORED RESEARCH OR DEVELOPMENT

Not applicable.

BACKGROUND OF THE INVENTION

1. Field of the Invention

The present invention is directed to an apparatus for aligning the front wheels of motor vehicles. More particularly, the present invention is directly a an apparatus for bending the front axle of a truck during the wheel alignment process. The degree of required bending is measured by a different apparatus that forms no part of the present invention.

2. Description of the Related Art Including Information Disclosed Under 37 C.F.R. 1.97 and 1.98

The wheels of motor vehicles, particularly the front wheels, must be properly aligned to prevent excessive wear of the tires, which may cause dangerous handling and uneven tread wear, and to insure proper handling of the motor vehicle during driving and to maximize the fuel efficiency of the motor vehicle. As the vehicle is driven, the alignment of the wheels deviates from the manufacturers's recommended settings, either through routine wear or from striking an obstacle, such as a curb or pothole. The vehicle must then be serviced to return the alignment of the wheels to their recommended alignment.

In the case of heavy trucks in particular, such as the tractor of a tractor-trailer rig, the wheels are brought into proper alignment by bending the front axles while the various alignment criteria, such as camber and so forth are monitored by an alignment measuring apparatus. This alignment apparatus forms no part of the present invention, which is solely directed to providing an apparatus for actually holding and bending the axles.

In related devices made in the past, conventional cylindrical apertures were used to provide bolt holes to hold an assembly together. This apparently worked for light trucks from the early to mid-twentieth century. As trucks have become heavier and stronger, however, the forces required to bend the axles of modern heavy trucks are too great for parts fastened together with cylindrical apertures to retain the fasteners and the bolts and connectors bend, rendering them unsuitable for aligning the front wheels of modern heavy trucks.

Therefore, the front axles of most large trucks are currently bent by a complex and expensive apparatus. This apparatus requires a concrete-walled pit below the floor of the garage with heavy anchors embedded into the floor of the pit. Heavy chains are fastened to these anchors, then wrapped around the axle in the desired location and pulled tight by one or more hydraulic rams that exert sufficient force on the axle to bend it the desired amount, as indicated by the alignment measuring apparatus. The chains are subject to snapping while under this tension. When a chain breaks, it flails about wildly with great energy and can easily cause serious property damage or personal injury. Therefore, current pit-oriented alignment systems are expensive and dangerous.

In the decades prior to about 1949, truck alignment was accomplished in some cases by providing a pair of spaced apart vertical struts each having a lower end fixed to a beam on the floor or in a pit. The upper ends of the struts retain a yoke that is placed over the top surface of the axle at a desired location along the length of the axle. Typically, one strut and yoke is attached to each front axle, but both struts and yokes can be attached to the same axle if desired. A hydraulic ram or jack is placed on the beam and presses upwardly on the axle at a desired location. The axle is bent in upward, with an effect on the wheel end that is determined by the relative placements of the strut and the ram and which may be either up or down. The struts and the ram are moved from place to place and the axle bent according to the needs of a particular alignment job until the wheels are brought into alignment. Such a system is disclosed in U.S. Pat. No. 1,739,891 issued to Dimmick on Dec. 17, 1929.

In other related apparatus, the struts are temporarily connected to the outer ends of the axles, as in U.S. Pat. No. 2,830,789 issued to MacMillian on Apr. 15, 1958.

This type of wheel alignment apparatus seems not to have been the subject of new patents since about 1958, with most patents in this field having appeared much earlier. Nor does it appear that this type of apparatus is in current use, having been supplanted by the chain and ram in a pit alignment apparatus described above. It is believed that this change in typical alignment apparatus has occurred because bending modern truck axles requires more force than such systems can withstand.

The modem usage of systems that require a pit in the garage seriously restrict the numbers of facilities that can offer wheel alignment services for large trucks because many shops cannot afford the cost of a pit and the associated equipment and necessary insurance or do not have space for one.

Therefore, there is a need for a wheel alignment apparatus for bending axles on motor vehicles that is relatively inexpensive, that does not require used of a concrete-lined pit, that eliminates the possibility of chains snapping under great force and thereby reduces insurance costs as well as the possibilities of personal injury and property damage from snapping chains, that is simple to use and that is durable and withstands the greater force requirements of large modern trucks.

BRIEF SUMMARY OF THE INVENTION

Accordingly, it is a primary object of the present invention to provide a wheel alignment apparatus for bending front axles on motor vehicles that is relatively inexpensive.

It is another object of the present invention to provide a wheel alignment apparatus for bending front axles on motor vehicles that does not require use of a concrete pit.

It is another object of the present invention to provide a wheel alignment apparatus for bending front axles on motor vehicles that eliminates the possibility of chains snapping under great force and thereby reduces insurance costs as well as the possibilities of personal injury and property damage from snapping chains.

It is another object of the present invention to provide a wheel alignment apparatus for bending front axles of motor vehicles that is simple to use.

It is another object of the present invention to provide a wheel alignment apparatus for bending front axles of motor vehicles that is durable and withstands the greater force requirements of large modem trucks.

Other objects and advantages of the present invention will become apparent from the following description taken in connection with the accompanying drawings, wherein is set forth by way of illustration and example, the preferred embodiment of the present invention and the best mode currently known to the inventor for carrying out his invention.

BRIEF DESCRIPTION OF THE SEVERAL VIEWS OF THE DRAWING

FIG. 5 is an exploded cross section of a side elevation of an upright arm assembly of the wheel alignment apparatus for bending front axles of FIG. 1.

FIG. 6 is a cross section side elevation of an upright arm assembly of the wheel alignment apparatus for bending front axles of FIG. 5 shown in its assembled configuration.

DETAILED DESCRIPTION OF THE INVENTION

Figure 1:
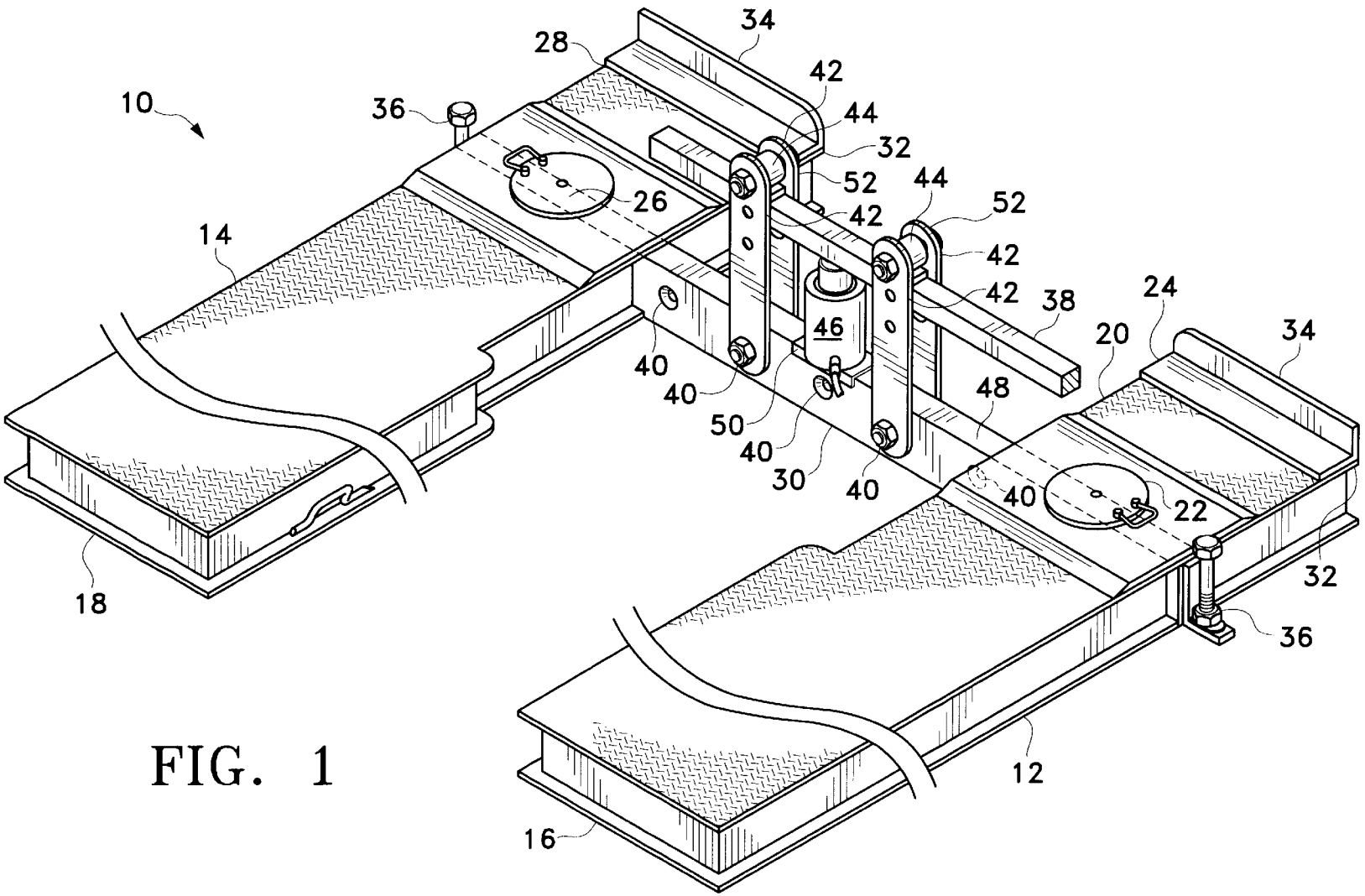
FIG. 1 is a left-hand rear perspective view of a wheel alignment apparatus for bending front axles according to the present invention.

Referring to FIG. 1, the wheel alignment apparatus for bending front axles 10 (alignment apparatus 10) includes a rack 11, which includes a left-hand rack member 12 and a right-hand rack member 14, which are parallel and spaced apart by the width of a typical large truck's front wheels and which are laid onto a level surface, such as the floor of a repair shop. Left-hand and right-hand orientations are determined from viewing the rack 11 from in front of it. The rack members 12, 14 are long enough to support the entire length of the cab and may include a ramp portion at the rear end 16, 18 of the rack members 12, 14, respectively, to facilitate driving the truck onto the rack. The rack members 12, 14 are typically made from welded steel plate, but may be made of any material suitable for supporting the tractor of a tractor-trailer rig. The front end of the rack 11 forms a positioning station 20 that includes a left-hand turn plate 22 located on the left-hand rack member 12 and adjacent to the front 24 end of the left-hand rack member 12. A right-hand turn plate 26 located on the right-hand rack member and adjacent to the front end 28 of the right-hand rack member 14. The truck's steering tires 15, 17 (FIGS. 7–9) are placed on the turn plates 22, 26, which can be rotated to turn the steering tires to a desired direction during alignment. The purpose of the rack 11 is to elevate the truck sufficiently to allow the steering tires of the truck to be placed on rotatable turn plates and to provide truck clearance and physical support for the anchoring beam 30. The anchoring beam 30 extends underneath the left-hand and right-hand rack members 12, 14 and the respective tire rests or turn plates 22, 26 to the outer edges of each rack member 12, 14. A separate leveling apparatus 36 is located on the outer edge of each rack member 12, 14 in alignment with the turn plates 22, 26, and the leveling apparatus are welded to the respective ends of the anchoring beam 30, allowing the weight of the truck to hold the anchoring beam 30 firmly against the floor. Alternatively, the turn plates 22, 26 and the beam 30 may be recessed into the floor and anchored by bolts or the like into the concrete, which eliminates the need for the rack members 12, 14.

Still referring to FIG. 1, a separate stop member 32 connected to the front end 20, 28 of each rack member 12, 14 respectively includes an upright flange portion 34 that helps prevent the truck from being driven over the front end of the rack 11. The rack 11 is leveled by adjusting the bolts in the leveling apparatus 36.

Still referring to FIG. 1, the anchoring beam 30, made from ASTM A-36 steel, is laid on the floor parallel to the general direction of the front truck axle 38 (shown schematically), includes five spaced mounting apertures 40 for mounting and securing four upright arms 42 to the anchoring beam 30. The upright arms 42 are all identical and are mounted and secured to the anchoring beam 30 in pairs, with two upright arms 42 directly across the width of the anchoring beam 30 from each other and the remaining two fastened to the anchoring beam across the width of the anchoring beam 30 from each other and spaced from the first pair of upright arms. A pressure distributor member 44 is fastened between each pair of opposed upright arms 42 adjacent to the tops of the upright arms 42. A ram 46, preferably a hydraulic ram, is placed on the top surface 48 of the anchoring beam 30 at any desired point along the length of the anchoring beam 30, where it is held slidably in place by the base plate 50.

Figure 2:
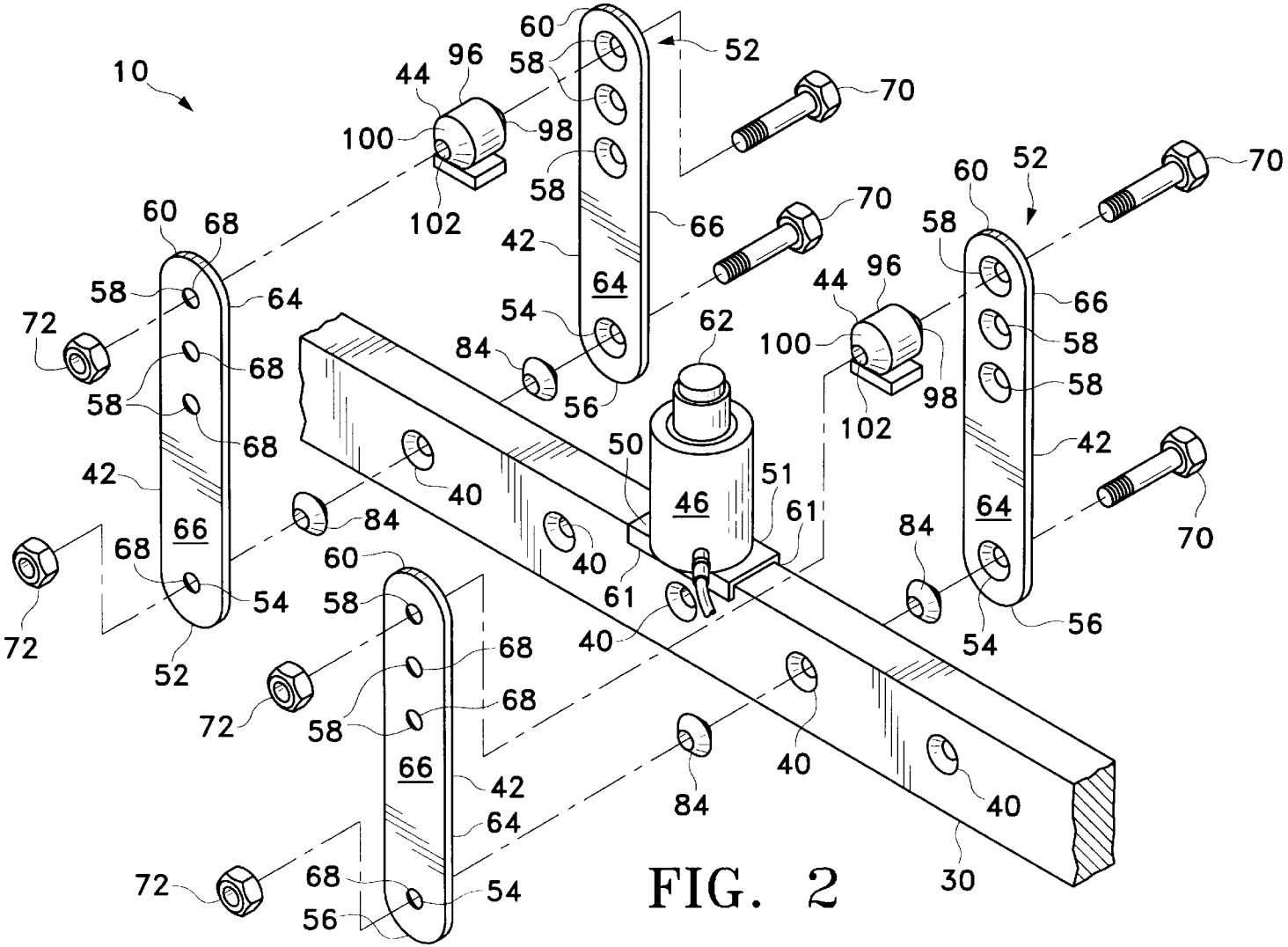
FIG. 2 is an exploded perspective view of the front portion of the wheel alignment apparatus for bending front axles of FIG. 1.

Referring now to FIG. 2, each pair of opposed upright arms 42, which are made from high tensile 2024-T352 aluminum, forms an upright arm assembly 52 when connected to the anchoring beam 30 and fitted with a pressure distributor member 44. between the adjacent upright arms 42. Each upright arm 42 includes a beam mounting aperture 54 adjacent to the lower end 56 of the upright arm 42. Each upright arm 42 includes three spaced pressure distributor member mounting apertures 58 descending from a position adjacent to the top end 60 of the upright arms 42. The pressure distributor members 44 may be fixed in any of these three apertures 58 in either upright arm assembly 52 as required to properly receive the front truck axle 38 for bending by the ram 46, which is fixed to the base plate 50 along the lower or bottom surface 51 of the ram 46, which includes parallel depending flanges 61 that run along the entire length of two opposed edges of the base plate 50 and are perpendicular to the plane of the base plate 50 and are marginally farther apart that the width of the anchoring beam 30 so that the ram 46 and base plate 50 can be slid together along the length of the anchoring beam 30. The depending flanges 61 on the base plate 50 allow the ram 46 to be moved to any desired position along the anchoring beam 30 without falling off readily. The ram conventionally includes a central piston 62 that reciprocates up and down in response to changes in hydraulic pressure within the ram 46.

Figure 4:
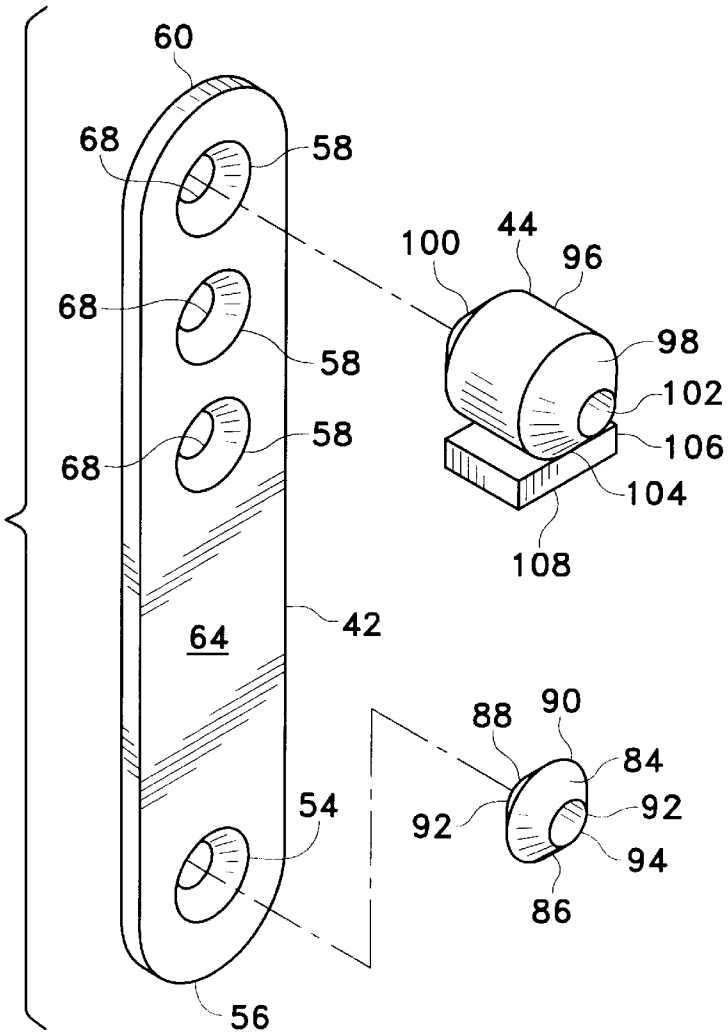
FIG. 4 is a perspective view of the upright arm of FIG. 3 illustrating the insertion of an upper pressure distributor and a lower anchoring eye.
Figure 3:
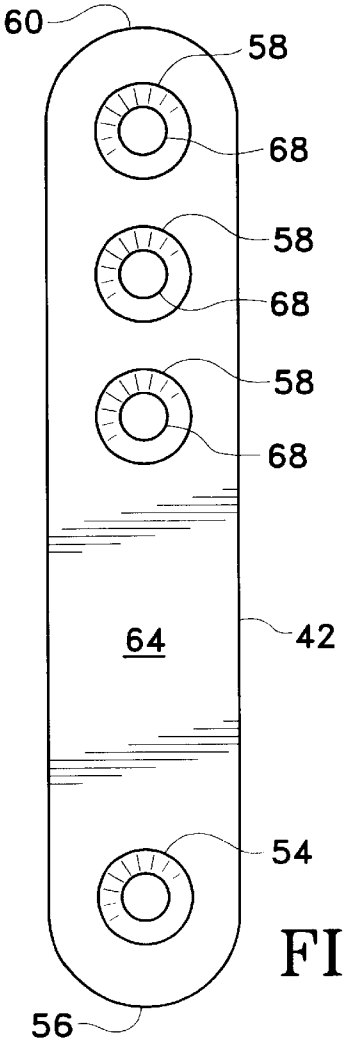
FIG. 3 is a front elevation of a an upright arm for use with the wheel alignment apparatus for bending front axles of FIG. 1.

Still referring to FIG. 2, and to FIGS. 3 and 4, each aperture 40, 54, 58 is a beveled aperture having a taper of 45° penetrating the particular member and having its widest opening on the face that will be butted against another face, forming a countersunk opening. In particular, each upright arm 42 has an inside face 64 that butts against the anchoring beam 30 and carries the widest opening of the tapered, or countersunk, apertures 54, 58. The outside face 66 of each upright arm 42 include an outside aperture portion 68 that is circular in cross section and is just large enough to accommodate a cylindrical fastener, which are the bolts 70, secured by the nuts 72, both made of grade 8 hard carbon steel.

Referring to FIGS. 5 and 6, each of the mounting apertures 40 in the anchoring beam 30 includes a central cylindrical portion 74 in open communication with a front face beveled aperture opening, or countersink, 76 in the front face 78 of the anchoring beam 30 and a rear face beveled aperture opening, or countersink, 80 in the rear face 82 of the anchoring beam 30, each having a taper of 45° with the widest portion on the respective face 80, 82 of the anchoring beam 30, providing a countersunk opening at each end of the mounting apertures 40.

As best seen in FIGS. 4, 5, a bushing 84, machined from grade 8 hard carbon steel in a single piece, includes two conical frustrum portions butted together or effectively joined together at their wider bases, that is a first conical frustrum portion 86 and a second conical frustrum portion 88, which taper inwardly from the center 90 to the outer edge 92 at an angle of 45° from the longitudinal center line of the bushing 84. An aperture 94 is formed along the longitudinal center line of the bushing 84.

As best seen in FIG. 6, a bushing 84 is inserted into the front face aperture opening 76 and the rear face beveled aperture opening 80 of the anchoring beam 30, and then the four upright arms 42 are placed against the anchoring beam 30 as shown and secured in place by the bolts 70 and nuts 72. The first and second conical frustrum portions 86, 88 of the bushings 84 seat and mate closely with the beveled apertures 40 in the anchoring beam 30 and the beam mounting apertures 54 in the upright arms 42. Because the bushings 84 are symmetrical about both their longitudinal axis and their vertical axis, either the first of second conical frustrum portion can be inserted into either the anchoring beam 30 aperture 40 or the upright arm 42 beam mounting aperture 54.

Referring to FIGS. 1–6 and as best seen in FIGS. 4, 5, and 6, the pressure distributor 44, which is machined from grade 8 high carbon steel, is removably connected between two adjacent upright arms 44 (FIG. 2) through one set of the pressure distributor mounting apertures 58 by the bolt 72 and nut 72. The pressure distributor 44 includes a cylindrical central portion 96 flowing in to a first pressure distributor conical frustrum 98 on one end and into a second conical frustrum 100. That is, the cylindrical central portion 96 is flanked on either side by a conical frustrum 98, 100. Both pressure distributor conical frustrums 98, 100 are identical, so either can be inserted into any countersunk opening 58 in any upright arm 58. A pressure distributor aperture 102 is a cylindrical aperture through the entire length of the pressure distributor 44 along its longitudinal centerline. Fixed to the bottom 104 of the cylindrical central portion of the pressure distributor 44 is a rectilinear distributor plate 106 having a flat bottom surface 108 that bears against the top surface of the front truck axle 30. The distributor plate 106, which may be welded to the central cylindrical portion 96, distributes the pressure and force imposed upon the axle over a wider area, thereby preventing sharp bends in the axle 30.

It has been found that use of the countersunk apertures 40, 54, 58 and the conforming fittings, namely the bushings 84 and the pressure distributor 44 spread the load throughout the upright arms 44 and the anchoring beam 30 more evenly than conventional cylindrical apertures connected with cylindrical bolts, thereby allowing the use of lighter and less expensive materials than would otherwise be required when deforming axles with forces sometimes exceeding 45,455 kilograms (50 tons). When conventional cylindrical apertures and bolts are used, the upward force from the ram places a shear force in the axle, which is then translated to horizontal forces that run to the upright supports, where they are again converted to upward shear forces. When the countersunk apertures, each filled with conical frustrum fitting, as described in this specification are used, the horizontal forces in the axle and pressure distributor 44 are distributed perpendicular to the outer surface of the conical frustrum, disbursing them more evenly throughout the upright arms 42 and reducing bending moments in them. In addition, the outside surface area of the conical portion of the conical frustrum has a surface area that is 1.5 times greater than a cylinder of having a length equal to the centerline length of the conical frustrum, providing a greater surface area over which to distribute forces where the different parts join.

Figure 7:
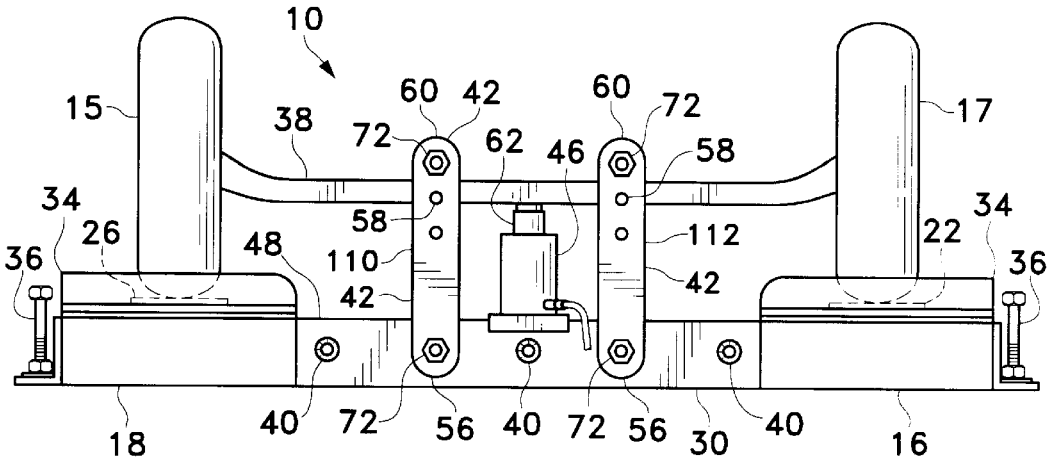
FIG. 7 is a rear elevation of the wheel alignment apparatus for bending front axles of FIG. 1 illustrating one bending configuration of a pair of upright arm assemblies of FIG. 6 with a hydraulic ram disposed between the two spaced upright arm assemblies.
Figure 8:
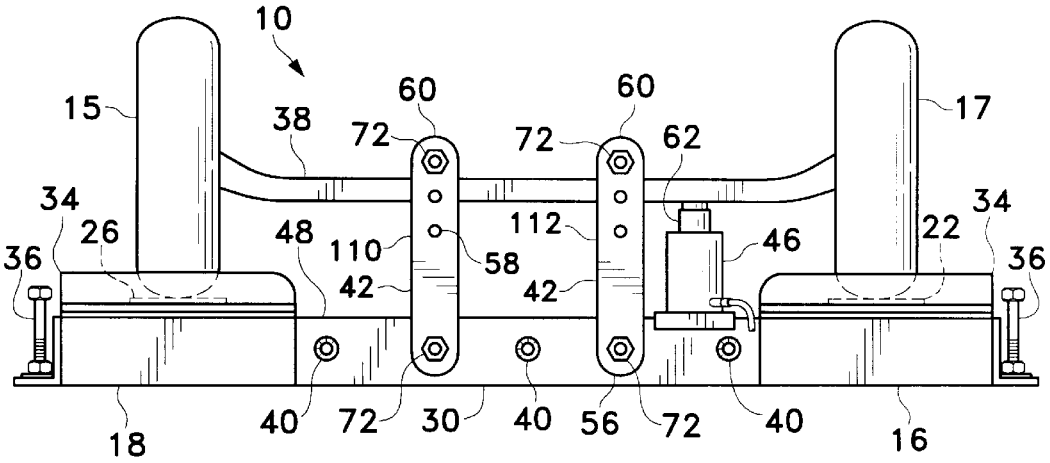
FIG. 8 is a rear elevation of the wheel alignment apparatus for bending front axles of FIG. 1 illustrating one bending configuration of a pair of upright arm assemblies of FIG. 6 with a hydraulic ram disposed outside and to the right-hand side of the space defined by the two spaced upright arm assemblies.
Figure 9:
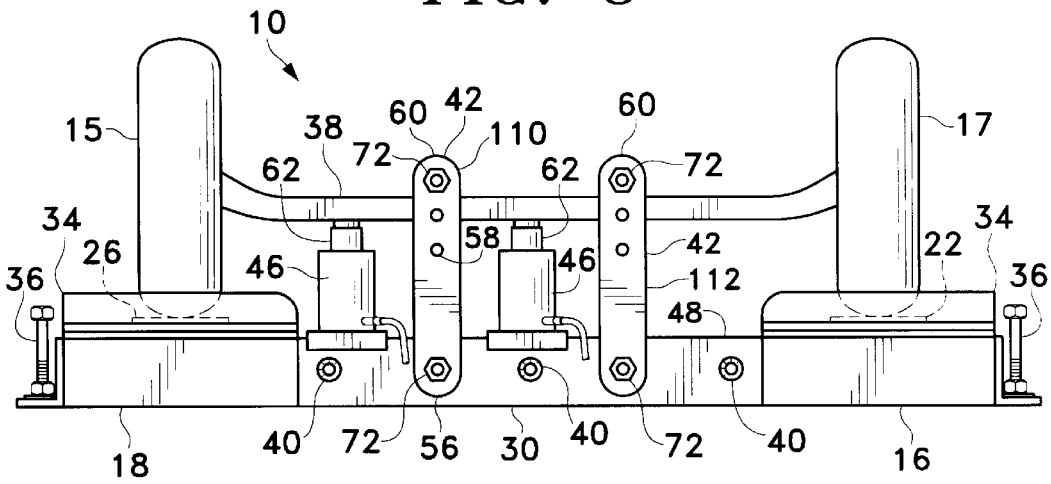
FIG. 9 is a rear elevation of the wheel alignment apparatus for bending front axles of FIG. 1 illustrating one bending configuration of a pair of upright arm assemblies of FIG. 6 with a hydraulic ram disposed outside and to the left-hand side of the space defined by the two spaced upright arm assemblies.

Referring to FIGS. 7–9, the ram 46 is placed on the anchoring beam 30 and presses upwardly against the front truck axle 38, which is restrained by the two pressure distributors 44 mounted on the upright arms 42, which are in turn held by being fastened to the anchoring beam 30. The ram 46 may be place between the left-hand upright arm assembly 110 and the right-hand upright arm assembly 112 (FIG. 7), or to the right of both upright arm assemblies 110, 112 (FIG. 8), or the left of both upright arm assemblies (FIG. 9), as required by the various bending requirements for alignment. Further, as shown in FIG. 9, a second ram 46 can be placed along the anchoring beam 30 between the two upright arm assemblies 110, 112, and may be placed anywhere along the anchoring beam 30 that is desired. The front truck axle 38 can thus be bent to raise or lower either the left tire 15 or the right tire 17 to achieve proper alignment of the front axle 38.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims.

I claim:

1. A wheel alignment apparatus for bending front axles comprising:

a. at least one upright arm assembly, said upright arm assembly further comprising a pair of upright arms, each said upright arm further comprising an inner face and an outer face and an upper end and a lower end, an anchoring beam aperture adjacent to said lower end and countersunk into said inner face and a plurality of spaced pressure distributor member mounting apertures adjacent to said upper end and countersunk into said inner face and a pressure distributor between said upright arms adjacent to said upper end of said upright arms, said pressure distributor further comprising a first conical frustrum portion and a second conical frustrum portion, each received in one said pressure distributor member mounting apertures in each of said two upright arms; and b. an anchoring beam having a plurality of spaced mounting apertures to which said upright arm is connected; and c. means for applying force to an axle, said force applying means being supported by said anchoring beam.

2. A wheel alignment apparatus for bending front axles in accordance with claim 1 wherein said pressure distributor further comprises a rectilinear distributor plate fixed to a bottom surface of said cylindrical central portion of said pressure distributor.

3. A wheel alignment apparatus for bending front axles in accordance with claim 1 wherein each said upright arm further comprises an inner face and an outer face and a plurality of spaced pressure distributor member mounting apertures countersunk into said inner face adjacent to said upper end of said upright arm and an anchoring beam aperture countersunk into said inner face adjacent to said lower end of each said upright arm.

4. A wheel alignment apparatus for bending front axles in accordance with claim 1 wherein said force applying means further comprises a hydraulic ram.

5. A wheel alignment apparatus for bending front axles in accordance with claim 1 wherein said mounting apertures in said anchoring beam further comprises a central cylindrical portion flanked by and connected to a countersunk portion in each of two opposed faces of said anchoring beam.

6. A wheel alignment apparatus for bending front axles in accordance with claim 5 further comprising a bushing between each said upright arm and said anchoring beam, said bushing further comprising a first conical frustrum joined to a second conical frustrum at the wider base of said first conical frustrum and second conical frustrum and an aperture through said bushing along its longitudinal axis, with one said conical frustrum seated in said countersunk portion of said mounting aperture of said anchoring beam and the other said conical frustrum portion seated in said beam mounting aperture in each said upright arm.

7. A wheel alignment apparatus for bending front axles in accordance with claim 6 further comprising a bolt through said anchoring beam, said bushing and said beam mounting aperture in each said upright arm and a nut securing said bolt.

8. A wheel alignment apparatus for bending front axles comprising:

a. at least one upright arm assembly, said upright arm assembly further comprising a pair of upright arms, each said upright arm further comprising an inner face and an outer face and an upper end and a lower end, an anchoring beam aperture adjacent to said lower end and countersunk into said inner face and a plurality of spaced pressure distributor member mounting apertures adjacent to said upper end and countersunk into said inner face; and a pressure distributor between said upright arms adjacent to said upper end of said upright arms, said pressure distributor further comprising a first conical frustrum portion and a second conical frustrum portion, each received in one said pressure distributor member mounting apertures in each of said two upright arms and each flanking a central cylindrical portion and an aperture through said pressure distributor along the longitudinal axis of said pressure distributor;

b. an anchoring beam having a plurality of spaced mounting apertures to which each said upright arm is connected, each said mounting apertures having a countersunk opening on each of two opposed faces of said anchoring beam;

c. a bushing between each said upright arm and said anchoring beam; and d. a hydraulic ram supported by a top surface of said anchoring beam.

9. A wheel alignment apparatus for bending front axles in accordance with claim 8 wherein said countersunk pressure distributor member mounting apertures and said anchoring beam aperture are tapered inwardly at an angle of 45°.

10. A wheel alignment apparatus for bending front axles in accordance with claim 8 further comprising two spaced said upright arm assemblies.

11. A wheel alignment apparatus for bending front axles in accordance with claim 8 wherein said bushing further comprises a first conical frustrum joined to a second conical frustrum at the wider base of said first conical frustrum and second conical frustrum and an aperture through said bushing along its longitudinal axis, with one said conical frustrum seated in said countersunk portion of said mounting aperture of said anchoring beam and the other said conical frustrum portion seated in said beam mounting aperture in each said upright arm.

* * * * *